United States Patent [19]

Carnaghi

[11] 4,412,369

[45] Nov. 1, 1983

[54] HOOK-LIKE END FOR DRAWSTRING

[75] Inventor: Arturo A. Carnaghi, St. Louis, Mo.

[73] Assignee: Angelica Corporation, St. Louis, Mo.

[21] Appl. No.: 387,695

[22] Filed: Jun. 11, 1982

[51] Int. Cl.[3] ..... A41F 1/00; A41D 13/04

[52] U.S. Cl. ..... 24/266; 24/143 R; 2/48; 2/52

[58] Field of Search ..... 24/143 R, 143 A, 143 B, 24/266; 2/48, 51, 52; 150/11

[56] References Cited

U.S. PATENT DOCUMENTS

| | | | |
|---|---|---|---|
| 1,743,729 | 1/1930 | Pope et al. | 2/51 |
| 1,823,057 | 9/1931 | Marx | 24/143 R |
| 2,148,152 | 2/1939 | Dosberg | 2/52 |
| 4,231,119 | 11/1980 | Quinn | 2/48 |

*Primary Examiner*—Robert P. Swiatek

*Attorney, Agent, or Firm*—Rogers, Eilers & Howell

[57] ABSTRACT

A hook-like end for a drawstring is formed by folding one end of the drawstring back on itself and then stitching that folded end so a hook-like portion of appreciable length is formed. If, through inadvertence or through deliberate intent, a force were to be applied to that drawstring which would tend to pull that end of that drawstring through a tubular passage on a garment, the hook-like portion would engage an outer surface of the tubular passage and halt movement of that drawstring inwardly relative to that passage.

4 Claims, 4 Drawing Figures

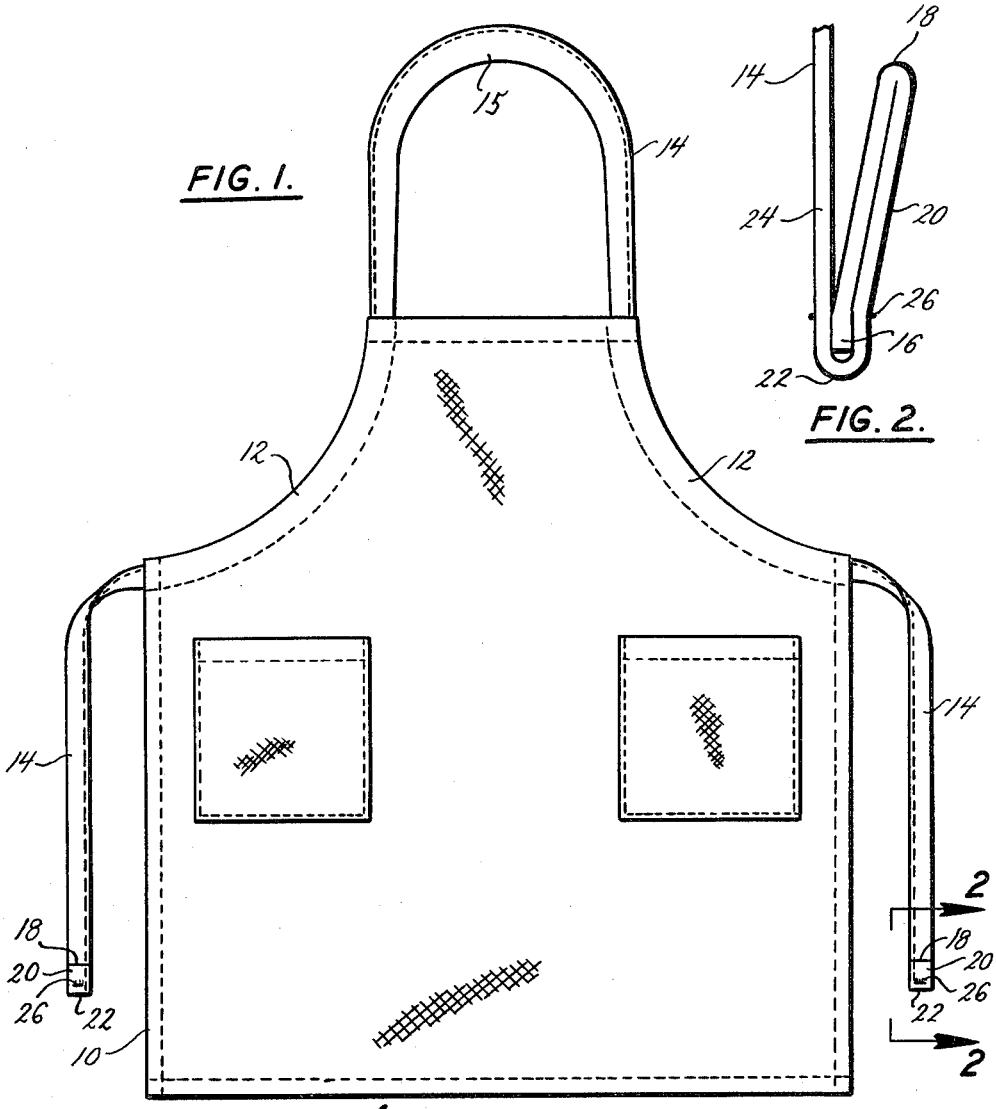
FIG. 1.
FIG. 2.
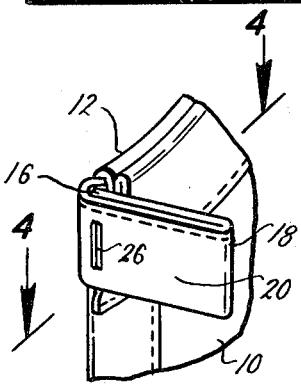
FIG. 3.
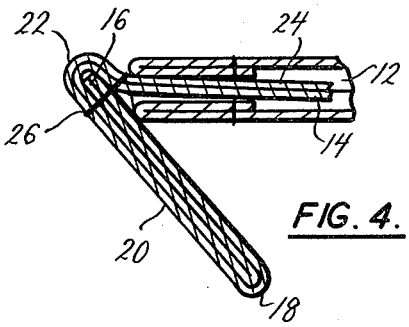
FIG. 4.

HOOK-LIKE END FOR DRAWSTRING

BACKGROUND OF THE INVENTION

1. Field of the Invention

Many garments utilize drawstrings that are slidably confined within tubular passages in those garments. It would be undesirable to permit the end of such a drawstring to be pulled into such a tubular passage, because it can be difficult and time-consuming to reach that end and then pull it out of that tubular passage.

2. Description Of The Prior Art

Buttons and other objects, which have cross sections larger than the cross sections of those tubular passages, have been secured to the ends of drawstrings to keep those drawstrings from being pulled inwardly of those tubular passages. However, buttons and other objects tend to be stiff and unyielding and, in many instances, to be breakable. Consequently, buttons or other objects which could be secured to the ends of drawstrings to keep those drawstrings from being pulled inwardly of tubular passages on garments would tend to break when those garments were washed and dried in washing machines and dryers.

SUMMARY OF THE INVENTION

The present invention provides an unbreakable, yieldable, inexpensive, compact and color-compatible hook-like end for a drawstring which is slidably confined within a tubular passage in a garment. That hook-like end is formed by folding an end of the drawstring back on itself and then stitching or otherwise securing the consequent folded end close to the fold. The resulting projecting portion of the folded end will act as a hook; so that if the drawstring were to be pulled inwardly relative to the tubular passage, the hook-like projecting portion of that folded end would engage a part of the outside surface of that tubular passage and would thereby keep that folded end from moving wholly within that tubular passage. By being part of the drawstring, the hook-like end is (a) unbreakable in washing, drying, pressing or use, (b) is yieldable so it is readily-compressed and will not bruise a person's body if it strikes a nearby object or is struck by a nearby object, (c) is inexpensive because it does not require a manufactured part such as a button, (d) is compact and occupies only a small space when the garment is stored, and (e) is compatible with the color scheme and motif of that drawstring. It is, therefore, an object of the present invention to provide a hook-like end for a drawstring which is slidably confined within a tubular passage in a garment and which is formed by folding one end of that drawstring back upon itself and then forming a line of stitching or other securement adjacent the fold to provide a projecting portion which can act as a hook.

Raw edges of fabrics can tend to ravel, and loose threads or fibers on the end of a drawstring would be objectionable. The present invention avoids loose threads or fibers on the end of a drawstring by forming a reversely-folded portion at that end of that drawstring, folding that reversely-folded portion back against an adjacent portion of the drawstring, and then forming a line of stitching or other securement adjacent the resulting fold. The major portion of the reversely-folded portion will be free to flex relative to the line of stitching or other securement; and it can act as a hook and engage an outer portion of the tubular passage for the drawstring if that drawstring were to be pulled inwardly relative to that tubular passage. The original free end of that drawstring will be enclosed, concealed and protected by the final fold adjacent the end of the drawstring, and it will be kept against raveling by the line of stitching or other securement which is closely adjacent to it. It is, therefore, an object of the present invention to provide a drawstring for a tubular passage in a garment by forming a reversely-folded portion at one end of that drawstring, folding that re-entrant end back against an adjacent portion of that drawstring, and then forming a line of stitching or other securement adjacent the resulting fold which passes through or immediately adjacent the original free end of that drawstring.

A drawstring should move freely, relative to the tubular passage therefor, through the full range of adjustment which is desired for that drawstring. Where, as in an apron which has a tubular passage at each side thereof, a drawstring has an exposed neck-engaging portion thereof spanning the space between the ends of two spaced-apart tubular passages, it would be desirable to keep that neck-engaging portion from accidentally shifting into either of those tubular passages. Also, it would be desirable to keep each of those tubular passages from accidentally telescoping over any appreciable length of that neck-engaging portion. The present invention keeps the neck-engaging portion of a drawstring, which spans the space between the ends of two spaced-apart tubular passages, from accidentally shifting into either of those tubular passages and also keeps each of those tubular passages from accidentally telescoping over any appreciable length of that neck-engaging portion; and it does so by making the width of the midpoint of that neck-engaging portion substantially greater than the internal width of either of those tubular passages, and also by tapering the sections of that neck-engaging portion which are on opposite sides of that midpoint. The tapered sections provide a pleasing and attractive appearance; and, because they are free of abrupt width-reducing steps, and also because they are flexible and yieldable in a transverse section, those tapered sections could, if desired, be drawn into the tubular passages. However, the width of the midpoint, and the width of the tapered sections of the neck-engaging portion, are great enough so that neck-engaging portion will actively resist accidental shifting of those tapered sections into either of the tubular passages. Also, those tapered sections will actively resist accidental telescoping of either of those tubular passages over appreciable lengths of those tapered sections. It is, therefore, an object of the present invention to provide a drawstring with a neck-engaging portion which spans the space between two tubular passages and which is wide enough (a) to resist accidental shifting into either of those tubular passages, and (b) to resist accidental telescoping of either of those tubular passages over appreciable lengths of that neck-engaging portion.

BRIEF DESCRIPTION OF THE DRAWING

In the drawing, FIG. 1 is a front elevational view of a garment which has tubular passages therein that hold portions of a drawstring which is equipped with the hook-like ends of the present invention;

FIG. 2 is a plan view, on a larger scale, of one of the hook-like ends of the drawstring of FIG. 1, FIG. 3 is a perspective view, on a scale intermediate those of FIGS. 1 and 2, of a portion of the drawstring and of a portion of the garment of FIG. 1, and FIG. 4 is a sectional view, on the scale of FIG. 2, which is taken along the plane indicated by the line 4—4 in FIG. 3.

DETAILED DESCRIPTION OF THE PREFERRED EMBODIMENT

Referring to the drawing in detail, the numeral 10 generally denotes a garment which has tubular passages 12 at the upper edges of the sides thereof. Although the garment is shown as an apron, and although those tubular passages are shown at the upper edges of the sides of that apron, those tubular passages could be made parts of many different garments, could be made parts of duffle bags and other objects, and could be located at any desired locations on any desired garments or objects. A few examples of other garments in which the present invention could be embodied are blouses, jackets, sweat pants, pajama trousers, and outer wear with adjustable hoods or cuffs or waists. The tubular passages 12 are large enough to permit easy and ready sliding movement of major portions of the length of a drawstring 14 which is confined within those tubular passages. Garments and other objects with tubular passages to slidably receive drawstrings are well known in the art; and hence neither the garment 10 nor the tubular passages 12 is, per se, a part of the present invention.

The numeral 16 denotes one of the original ends of the drawstring 14; and the numeral 18 denotes a fold in that drawstring which is spaced from that original end and which defines a flap that is generally denoted by the numberal 20. That flap begins at the original end 16, extends outwardly to the fold 18, and then extends to a further fold 22. That further fold is formed as the flap 20 and is folded back against an adjacent portion 24 of the drawstring 14. A row 26 of stitching or other securement is provided close to the fold 22; and it passes through or otherwise fixes the position of the original end 16. The row 26 of stitching or other securement will hold the original end 16 within a closed space which is defined by the fold 22 and the two adjacent portions of the drawstring 14; and that fold and those portions will overlie, conceal and protect that original end. By passing through, or by otherwise fixing, the free edge of the original end 16, the row 26 of stitching or other securement will limit any tendency of that free edge to ravel.

Because the row 26 of stitching or other securement is close to the fold 22, the flap 20 will be held so it constitutes a re-entrant end for the drawstring 14 but will have its free edge movable away from the adjacent portion of the drawstring to act as a hook-like end for that drawstring. If, as indicated particularly by FIGS. 3 and 4, the drawstring 14 were to be pulled inwardly relative to one of the tubular passages 12, the free edge or some other portion of the flap 20 would engage an outer surface of that tubular passage, and would thereby halt further inward movement of that drawstring. A flap 20 is provided at each end of the drawstring 14; and hence both ends of that drawstring have hook-like configurations.

The drawstring 14 will be positioned within the tubular passage 12 before the flaps 20 are formed, before the folds 22 are formed, and before the rows 26 of stitching or other securement are formed. Thereafter, those flaps will prevent the ends of the drawstring 14 from being pulled wholly within the tubular passages 12.

Where the drawstring 14 is made of fabric, the row 26 will usually be formed by stitching. Where that drawstring is made of heat softenable plastic or of some other material which is capable of securement by heat or ultrasonic welding, the row 26 can be formed by use of a heating or ultrasonic welding process.

FIG. 4 shows the drawstring 14 as being made from a two-ply material; and such an arrangement is desirable where the material is thin and very flexible. However, where the material of a drawstring is thick and somewhat less flexible, that drawstring can be made from a single ply of material.

The forming of the fold 18 is important in the making of the flap 20 where the material of the drawstring 14 is thin or could easily fray or the original end 16 should be concealed. However, where the material of that drawstring is relatively stiff and will not fray and an exposed original end is not objectionable, the fold 18 could be dispensed with, and the flap 20 could be a single ply with the original end of the drawstring constituting the free edge of that flap.

As shown particularly by FIG. 4, the flap 20 has a thickness which is greater than the width of the space defined by the tubular passage 12. Even if the thickness of that flap was no greater than the thickness of the drawstring 14—as would be the case if that flap did not have a fold 18 and the original end 16 of that drawstring constituted the free edge of that flap—the sum of the thicknesses of that drawstring and of that flap would exceed the width of the space defined by the tubular passage 12. This means that even if the free edge of the flap 20 was not initially spaced away from an adjacent portion of the drawstring 14, that free edge could not enter that tubular passage—and hence would be forced to move away from that adjacent portion of that tubular passage to act as a hook-like end for that drawstring.

In one preferred embodiment of the present invention, the drawstring 14 has a neck-engaging portion which extends upwardly from, and spans the space between, the upper ends of the tubular passages 12. That neck-engaging portion, like the rest of that drawstring, is flexible and yieldable; and hence it will feel comfortable when it is extended around the user's neck. A point of maximum width, which is denoted by the numeral 15, is provided for that neck-engaging portion; and tapered sections extend for appreciable distances in both directions from that point toward the upper ends of tubular passages 12. In the said preferred embodiment, the tapered sections are free of abrupt, width-reducing steps, the point of maximum width is about an inch and one-half wide, each of the tapered sections which extend in opposite directions from the point of maximum width is about fifteen inches long, and each of the other sections of the drawstring is about three-quarters of an inch wide. Also in that preferred embodiment, the portion of the flap 20 which is intermediate the fold 18 and the row 26 of stitching or other securement is about three-quarters of an inch long. It will, however, be recognized that the width of the point of maximum width, the length of the tapered sections, the width of the other sections of the drawstring 14, and the lengths of the portion of flaps 20 which are intermediate the folds 18 and the rows 26 can be varied widely. The important requirements of the point of maximum width and of the tapered sections of the neck-engaging portion are that they (1) actively resist accidental shifting of that neck-engaging portion into either of the tubular passages 12 and (2) actively resist accidental telescoping of either of those tubular passages over an appreciable length of either of those tapered sections. The important requirement of the portion of each flap 20 which is intermediate the fold 18 and the row 26 is that it enables that flap to act as a hook-like end for the drawstring 14.

If it ever became desirable to shift the neck-engaging portion of the drawstring 14 into either of the tubular passages 12, the flexible and yieldable material of that neck-engaging portion could bend in transverse section to permit such shifting. Similarly, if it ever became desirable to telescope either of those tubular passages over an appreciable length of one of those tapered sections, the flexible and yieldable material of that tapered section would permit that section to bend in transverse section to permit such telescoping. Also, because neither of those tapered sections has abrupt, width-reducing steps therein, those tapered sections would not prevent or halt shifting of that neck-engaging portion into either of the tubular passages 12 and also would not prevent or halt telescoping of either of those tubular passages over an appreciable length of one of those tapered sections. However, the resistance of the material of the neck-engaging portion to bending and flexing in transverse section will be great enough to enable that portion (a) to actively resist accidental shifting thereof into either of the tubular passages 12 and (b) to actively resist accidental telescoping of either of those tubular passages over an appreciable length of one of those tapered sections.

Where, as shown by FIG. 4, the drawstring 14 is made as two plies, it can be made by folding a strip of material lengthwise and then stitching together its free elongated edges, or it can be made by placing one ply atop another ply and then stitching both sets of free elongated edges. The fold of the lengthwise folded strip of material will be straight; so the free elongated edges will have to be cut to provide the tapered sections that form the point 15 of maximum width. That folded drawstring could be disposed within the tubular passages so either the fold or the stitched elongated edges thereof would confront and engage the user's neck.

Where the drawstring 14 is made by placing one ply atop another ply and then stitching both sets of free elongated edges, one of those sets of free elongated edges could be cut straight while the other of those sets of free elongated edges was cut to provide the tapered sections that form the point 15 of maximum width. Alternatively, both of those sets of free elongated edges could be cut so they were curved; and, in that event, those two sets of free elongated edges would coact to provide the tapered sections that form the point 15 of maximum width. In either event, the drawstring 14 could be disposed within the tubular passages so either set of stitched elongated edges thereof would confront and engage the user's neck.

The apron of FIG. 1 is shown equipped with two pockets; but those pockets are not parts of the present invention. As a result, that apron could be made with more, fewer or no pockets.

Whereas the drawing and accompanying description have shown and described a preferred embodiment of the present invention, it should be apparent to those skilled in the art that various changes may be made in the form of the invention without affecting the scope thereof.

What I claim is:

1. A drawstring which comprises a first portion that is disposed within a tubular passage, a second portion that extends outwardly from one end of said tubular passage and that has a width substantially greater than the internal width of said tubular passage, and a third portion that extends outwardly from the other end of said tubular passage and that has a hook-like end, said hook-like end including a fold and a projecting portion and stitching or other securement which passes through said projecting portion and an adjacent portion of said drawstring to hold said projecting portion near, and generally parallel to, said adjacent portion of said drawstring, said projecting portion having at least two plies held by said stitching or other securement to enable said projecting portion to successfully resist a bending thereof which would cause said projecting portion to assume a position wherein it was generally aligned with, and acted as an extension of, said adjacent portion of said drawstring and which would thereby permit said hook-like end to be pulled inwardly into said tubular passage, whereby said hook-like end can continuously serve as a hook which can engage an outer surface of said tubular passage and thereby block movement of said hook-like end into said tubular passage in the event an effort were to be made to move said third portion inwardly relative to said tubular passage, said engagement of said hook-like end with said outer surface of said tubular passage positively preventing further inward movement of said third portion relative to said tubular passage, said second portion being made of flexible and yieldable material and being free of abrupt, width-reducing steps so said second portion can be moved into said tubular passage although the substantially greater width of said second portion will resist but will not prevent accidental movement of said second portion into said tubular passage and will thereafter resist but will not prevent movement of said second portion relative to said tubular passage.

2. A drawstring which comprises a first portion that is disposed within a tubular passage, a second portion that extends outwardly from one end of said tubular passage and that has a hook-like end, said hook-like end comprising a fold adjacent one end of said drawstring that defines a flap at said one end of said drawstring, and stitching or other securement adjacent said fold which passes through said flap and an adjacent portion of said drawstring to hold said flap near, and generally parallel to, said adjacent portion of said drawstring, said flap having at least two plies held by said stitching or other securement to enable said flap to resist a bending thereof which would cause said flap to assume a position wherein it was generally aligned with, and acted as an extension of, said adjacent portion of said drawstring and which would thereby permit said hook-like end to be pulled inwardly into said tubular passage, said fold causing said flap to constitute a re-entrant end for said drawstring while permitting the free edge of said flap to move away from said adjacent portion of said drawstring, whereby said flap continuously constitutes a hook-like end for said drawstring which can engage an outer surface of said tubular passage and thereby block movement of said hook-like end into said tubular passage in the event an effort were to be made to move said flap and said one end of said drawstring inwardly relative to said tubular passage, said engagement of said flap of said hook-like end with said outer surface of said tubular passage positively preventing further inward movement of said flap and of said one end of said drawstring relative to said tubular passage.

3. A drawstring with a hook-like end which comprises a first portion that is disposed within a tubular passage, a second portion that extends outwardly from one end of said tubular passage and that has said hook-like end, said hook-like end comprising a fold adjacent one end of said drawstring that defines a flap at said one end of said drawstring, and stitching or other securement adjacent said fold to cause said flap to constitute a re-entrant end for said drawstring while permitting the free edge of said flap to move away from an adjacent portion of said drawstring, whereby said flap constitutes said hook-like end for said drawstring which can engage an outer surface of said tubular passage in the event said drawstring were to be moved inwardly relative to said tubular passage, said engagement of said hook-like end with said outer surface of said tubular passage preventing further inward movement of said drawstring relative to said tubular passage, the original end of said drawstring being folded back on itself to make said flap a plural-ply flap, said stitching or other securement passing through said original end of said drawstring to prevent raveling of said original end, and said fold and adjacent portions of said drawstring concealing, confining and protecting said original end of said drawstring.

4. A drawstring which comprises a first portion that is disposed within a first tubular passage, a second portion that is disposed within a second tubular passage which is spaced away from said first tubular passage, and a third portion that spans the space between said tubular passages, said third portion having a wide section therein which is substantially wider than the internal width of either of said tubular passages, said wide section resisting accidental movement of said third portion into either of said tubular passages and also resisting accidental telescoping of said tubular passages over said wide section, said wide section being bendable in transverse section to permit said third portion to be moved into either of said tubular passages, said third portion having a tapered section intermediate said wide section and one of said tubular passages, and said third portion being made of flexible and yieldable material and being bendable in transverse section to permit said tapered section of said third portion to enter said one of said tubular passages, but the resistance of said third portion to bending in transverse section enabling said third portion to resist but not prevent telescoping of said one tubular passage over said tapered section and thereafter to resist but not prevent movement of said third portion relative to said one tubular passage, said tapered section of said third portion being free of abrupt width-reducing steps which could prevent movement of said tapered section of said third portion into said one tubular passage.

* * * * *